US008857535B2

(12) United States Patent
Sugimoto

(10) Patent No.: US 8,857,535 B2
(45) Date of Patent: Oct. 14, 2014

(54) OIL PULSE ROTARY TOOL

(75) Inventor: Manabu Sugimoto, Anjo (JP)

(73) Assignee: Makita Corporation, Anjo-Shi (JP)

( * ) Notice: Subject to any disclaimer, the term of this patent is extended or adjusted under 35 U.S.C. 154(b) by 759 days.

(21) Appl. No.: 13/115,659

(22) Filed: May 25, 2011

(65) Prior Publication Data

US 2012/0000684 A1 Jan. 5, 2012

(30) Foreign Application Priority Data

Jul. 2, 2010 (JP) ..... 2010-152338

(51) Int. Cl.

| | |
|---|---|
| ***B25B 21/02*** | (2006.01) |
| ***B25B 23/14*** | (2006.01) |
| ***B25D 9/00*** | (2006.01) |
| ***B25B 23/147*** | (2006.01) |

(52) U.S. Cl.

CPC ..... *B25B 21/02* (2013.01); *B25B 23/1405* (2013.01); *B25B 23/1475* (2013.01); *B25B 23/14* (2013.01); *B25D 9/00* (2013.01)

USPC ..... 173/200; 173/205; 173/93; 173/93.5; 173/176

(58) Field of Classification Search

CPC ..... B25B 23/145; B25B 23/14; B25B 21/02; B25B 23/1405; B25B 23/1475; B25D 11/06; B25D 15/00; B25D 9/00

USPC ..... 173/93, 93.5, 200, 176, 205; 464/35, 464/37, 24–25

See application file for complete search history.

(56) References Cited

U.S. PATENT DOCUMENTS

| | | | | |
|---|---|---|---|---|
| 5,080,180 | A | 1/1992 | Hansson | |
| 5,706,902 | A | 1/1998 | Eisenhardt | |
| 6,968,908 | B2 * | 11/2005 | Tokunaga et al. | 173/181 |
| 7,032,685 | B2 * | 4/2006 | Nakamizo | 173/93.5 |

FOREIGN PATENT DOCUMENTS

| | | | |
|---|---|---|---|
| DE | 39 37 816 | A1 | 6/1990 |
| DE | 195 10 578 | A1 | 9/1996 |
| EP | 1 120 199 | A2 | 8/2001 |
| JP | B2-3653205 | | 3/2005 |

OTHER PUBLICATIONS

Oct. 19, 2011 Search Report issued in European Application No. EP 11 16 8923.8.

* cited by examiner

*Primary Examiner* — Michelle Lopez
(74) *Attorney, Agent, or Firm* — Oliff PLC

(57) ABSTRACT

A sleeve body with bearings interposed between the sleeve body and a center shaft portion is integrally coupled to an oil pulse generator. A coupling body is rotatable together with the output portion. Balls are fitted between an outer surface of the sleeve body and an inner surface of the coupling body. Cam grooves are L-shaped in plan view, and formed in a portion of the outer surface of the sleeve body at which the balls are fitted. Rotation of the output portion is transmitted from the coupling body to the sleeve body and the oil pulse generator via the balls. When rotational speed between the sleeve body and the coupling body is different, the balls relatively turn in the cam grooves to move the coupling body forward against an urging force of the coil spring so as to relieve an impact.

8 Claims, 3 Drawing Sheets

OIL PULSE ROTARY TOOL

BACKGROUND OF THE INVENTION

This application claims the benefit of the Japanese Patent Application No. 2010-152338 filed on Jul. 2, 2010, the entirety of which is incorporated by reference.

1. Field of the Invention

The present invention relates to an oil pulse rotary tool that intermittently produces a large torque using an oil pulse generator.

2. Description of the Related Art

Japanese Patent No. 3653205 Publication discloses an oil pulse rotary tool that buffers an impact force produced by oil pressure of an oil pulse generator. According to the oil pulse rotary tool disclosed in Japanese Patent No. 3653205, when rotation speed of an output shaft of the oil pulse generator is reduced during screw tightening by a bit mounted to the output shaft, a ball retracts along a cam groove provided in a spindle of the speed reduction mechanism between the spindle and a hammer fitted on the spindle with play therebetween. As a result, the hammer retracts against an urging force of a coil spring, and the above impact force can be effectively buffered in accordance with the spring force of the coil spring.

In the above oil pulse rotary tool, the coil spring is provided between the speed reduction mechanism and the hammer which corresponds to a coupling body coupled to the speed reduction mechanism, in the axial direction of the spindle. Therefore, it is necessary to secure a space for arrangement of the coil spring between the speed reduction mechanism and the coupling body. Thus, an increase in the external dimensions of a housing to accommodate the coil spring causes an increase in the overall length of the oil pulse rotary tool including the housing.

SUMMARY OF THE INVENTION

In view of such circumstances, an object of the present invention is to provide an oil pulse rotary tool with not increasing the overall length of the oil pulse rotary tool even if a coil spring urging a coupling body is provided.

A first aspect of the present invention provides an oil pulse rotary tool including a housing, a motor, a speed reduction mechanism, an oil pulse generator, a sleeve body, a coupling body, a ball, a cam groove and a coil spring. The motor is accommodated in the housing, and the speed reduction mechanism is accommodated in the housing, and a torque is transmitted from the motor to the housing. The oil pulse generator is accommodated in the housing and disposed in front of and coaxially with an output portion serving as a final stage of the speed reduction mechanism. The sleeve body is integrally coupled to the oil pulse generator, externally mounted on and coaxially with a center shaft portion, which is provided to project from a center of rotation of the output portion with a bearing interposed between the sleeve body and the center shaft portion. The coupling body is externally mounted on and coaxially with the sleeve body so as to be rotatable together with the output portion and axially movable. The ball is fitted between an outer surface of the sleeve body and an inner surface of the coupling body across the outer surface of the sleeve body and the inner surface of the coupling body. The cam groove is L-shaped in plan view, inclined to an axial direction and formed in a portion of the outer surface of the sleeve body at which the ball is fitted. The coil spring is externally mounted on the oil pulse generator to urge the coupling body toward a retracted position at which the ball is fitted at a rear end of the cam groove. A rotation of the output portion is transmitted from the coupling body to the sleeve body and the oil pulse generator via the ball. When rotational speed between the sleeve body and the coupling body is different, the ball relatively turns in the cam groove to move the coupling body forward against an urging force of the coil spring to relieve an impact.

A second aspect of the present invention provides the oil pulse rotary tool according to the first aspect, in which two bearings are disposed in the axial direction between the center shaft portion and the sleeve body.

According to the oil pulse rotary tool of the first aspect of the present invention, the length of the housing in the front-rear direction can be reduced unlike in the case where the coil spring aligned with the oil pulse generator is provided on the side of the final stage of the speed reduction mechanism in the rear of the oil pulse generator. Accordingly, it is possible to suppress an increase in the overall length of the oil pulse rotary tool including the housing.

According to the oil pulse rotary tool of the second aspect of the present invention, the two bearings disposed in the axial direction of the sleeve body can absorb not only a thrust load applied on the center shaft portion but also a radial load applied on the center shaft portion. Thus, it is possible to prevent the center shaft portion from excessively interfering with the sleeve body.

DETAILED DESCRIPTION OF THE PREFERRED EMBODIMENTS

Figure 1:
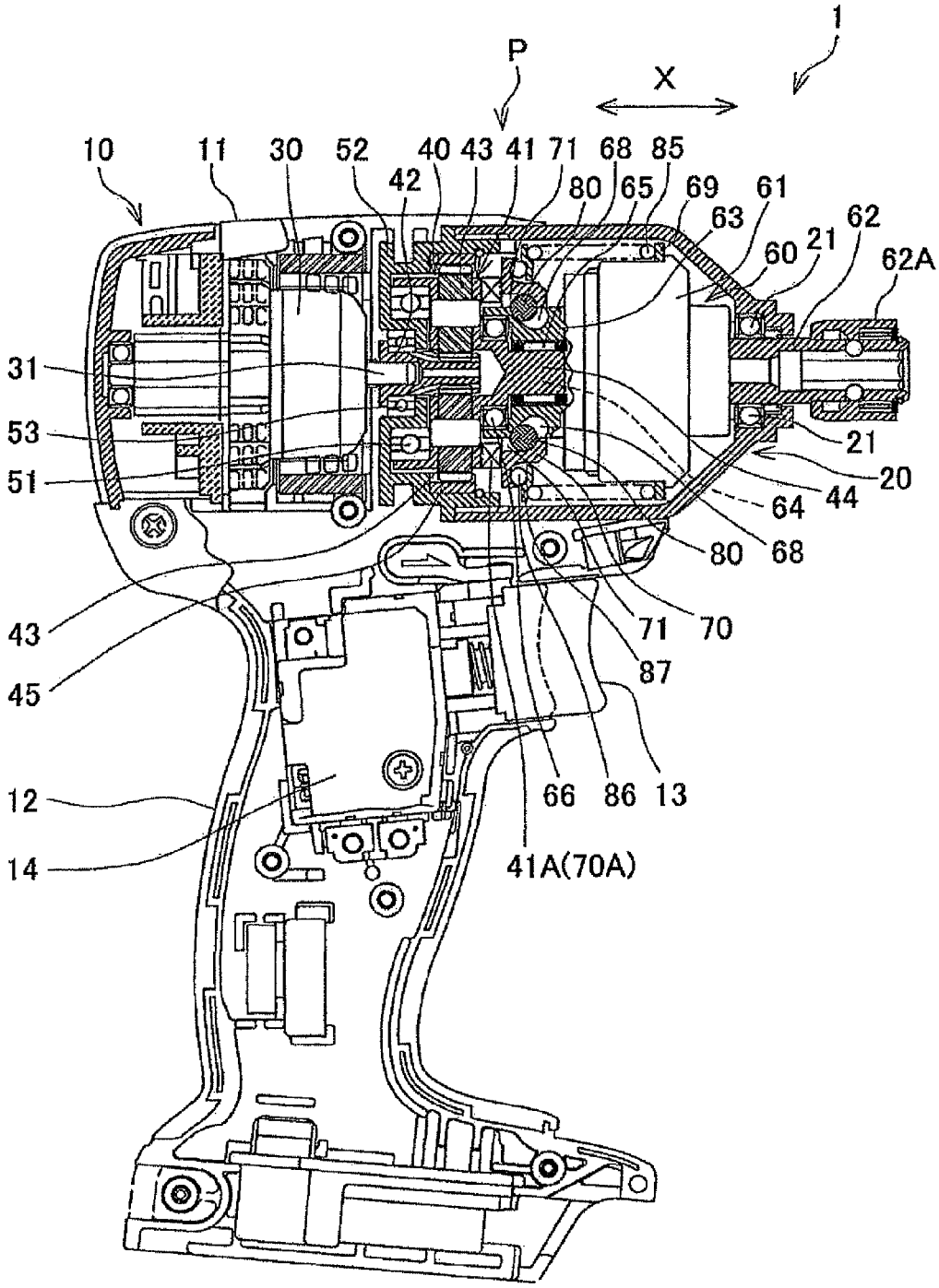
FIG. 1 is a longitudinal sectional view of an oil pulse driver according to an embodiment of the present invention.

An embodiment of the present invention will be described with reference to FIGS. 1 to 3. An oil pulse driver 1 shown in FIG. 1 includes a housing 10 and a unit case 20. The housing 10 is formed by assembling left and right half housings made of a resin, and includes a body portion 11 and a handle portion 12. The body portion 11 is formed in a cylindrical shape to extend in the front-rear direction of the oil pulse driver 1 (in the left-right direction in FIGS. 1 and 3). A motor 30 and a planetary gear speed reduction mechanism 40 are accommodated inside the body portion 11. The oil pulse driver 1 is an example of the oil pulse rotary tool according to the present invention.

Figure 3:
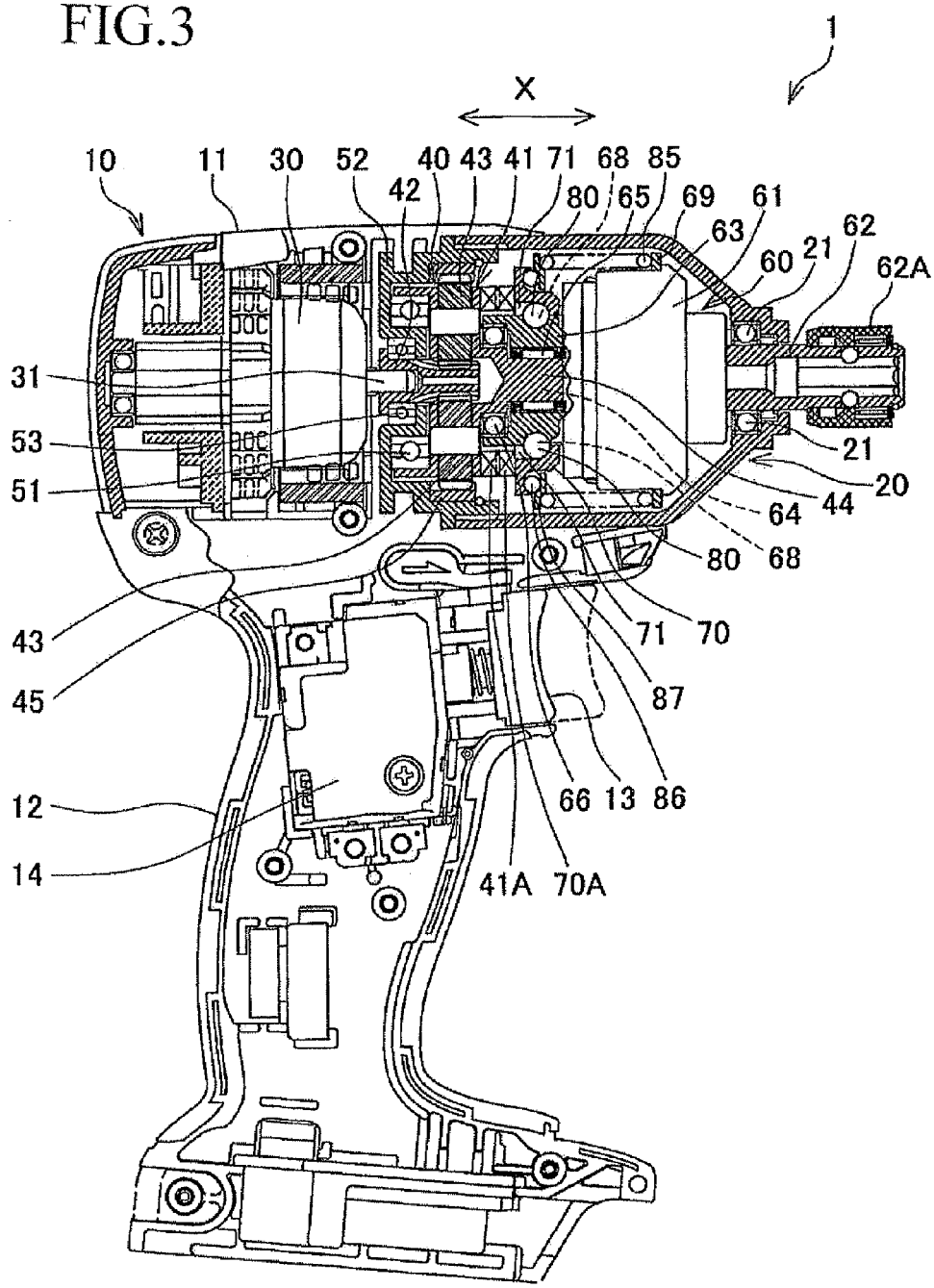
FIG. 3 is a longitudinal sectional view of the oil pulse driver at the time when an oil unit produces an impact torque.

The motor 30 is disposed in the rear portion of the body portion 11 (on the left side in FIGS. 1 and 3). The planetary gear speed reduction mechanism 40 is disposed in front of the motor 30 in the body portion 11 (on the right side in FIGS. 1 and 3). The planetary gear speed reduction mechanism 40 includes a carrier 41, a pinion 42, planetary gears 43, 43, a center shaft portion 44, and an internal gear 45.

The carrier 41 is rotatably journaled on an inner surface of a gear housing 52 through a ball bearing 51. The pinion 42 is secured to an output shaft 31 of the motor 30, and rotatably journaled on the gear housing 52 through a ball bearing 53. In addition, the carrier 41 is externally mounted on the pinion 42.

The planetary gears 43, 43 are journaled on the carrier 41 to mesh with the pinion 42. The internal gear 45 is fixed in the gear housing 52 to mesh with the planetary gears 43, 43. The carrier 41 is an example of the output portion according to the present invention.

As shown in FIGS. 1 and 3, the handle portion 12 is provided continuously from the body portion 11 to form a generally T-shape as the oil pulse driver 1 is viewed from a side surface. A switch 14 having a trigger 13 is accommodated inside the handle portion 12. When the trigger 13 is pulled, electric power is supplied to drive the motor 30.

The unit case 20 is disposed in front of the gear housing 52 (on the right side in FIGS. 1 and 3) to be assembled to the front of the body portion 11 (on the right side in FIGS. 1 and 3). An oil unit 60 is accommodated inside the unit case 20 which is positioned in front of the gear housing 52. Therefore, the oil unit 60 is disposed in front of and coaxially with the carrier 41 which is accommodated in the gear housing 52. It should be noted that the oil unit 60 is an example of the oil pulse generator according to the present invention. Further, the housing 10 and the unit case 20 are an example of the housing according to the present invention.

The oil unit 60 includes a main body 61, a shaft 62, and a sleeve body 63 integrally coupled to the main body 61. The sleeve body 63 is provided coaxially with the main body 61 to project from the rear end surface of the main body 61. The center shaft portion 44, formed to project from the front end surface of the carrier 41, is inserted into a hollow portion 64 of the sleeve body 63 with the axis of the center shaft portion 44 aligned with the axis of the sleeve body 63 extending in the front-rear direction (in the left-right direction in FIGS. 1 and 3).

Further, a needle bearing 65 and a ball bearing 66 are disposed in the hollow portion 64 of the sleeve body 63 in a center axis direction X of the sleeve body 63 (see FIGS. 1 to 3). The front portion of the center shaft portion 44 is journaled in the hollow portion 64 through the needle bearing 65. A stepped portion is formed inside the sleeve body 63 so as to increase the diameter of the hollow portion 64. The rear portion of the center shaft portion 44 is journaled on the stepped portion via the ball bearing 66. The sleeve body 63 is externally mounted on the center shaft portion 44 in a state that the center shaft portion 44 is inserted into the hollow portion 64 via both the bearings 65, 66. The needle bearing 65 and the ball bearing 66 are an example of the bearing according to the present invention.

A coupling ring 70 is externally mounted on and coaxially with the sleeve body 63 so as to be movable. Cam teeth 70A (see FIGS. 1 and 3) are provided to project from the rear end surface of the coupling ring 70 (on the left side in FIGS. 1 to 3). Cam teeth 41A (see FIGS. 1 and 3) are provided to project from the front end surface of the carrier 41 (on the right side in FIGS. 1 to 3) so as to oppose the cam teeth 70A. When the cam teeth 70A is meshed with the cam teeth 41A in the circumferential direction of the coupling ring 70 and the carrier 41, the carrier 41 and the coupling ring 70 can be integrally coupled to each other. Therefore, the coupling ring 70 is rotatable together with the carrier 41. The coupling ring 70 is an example of the coupling body according to the present invention.

Recessed grooves 71, 71 are reversed L-shaped in plan view, and formed in an inner surface of the coupling ring 70. On the other hand, cam grooves 68, 68 are L-shaped in plan view, and provided to be recessed in an outer surface of the sleeve body 63. The cam grooves 68, 68 are inclined from the center axis side of the sleeve body 63 toward the outer surface side of the sleeve body 63. Balls 80 are fitted between the inner surface of the coupling ring 70 and the outer surface of the sleeve body 63 across the recessed grooves 71, 71 and the cam grooves 68, 68.

Figure 2A:
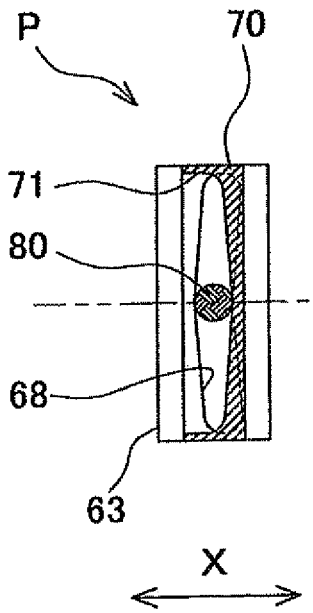
FIG. 2A illustrates a state in which a coupling ring is disposed with a ball fitted at a corner portion of a cam groove on a sleeve body.

In the embodiment, a coil spring 85 is disposed between a front washer 69 that is externally mounted at the front end of the main body 61 of the oil unit 60 and the coupling ring 70 in a state that the main body 61 is fitted in the coil spring 85. Therefore, it enables the coil spring 85 to be externally mounted on the main body 61. When the coil spring 85 urges the coupling ring 70 rearward in the center axis direction X as shown in FIG. 1, the coupling ring 70 is urged toward a position P (hereinafter referred to as a "retracted position P") where the balls 80, 80 are fitted at the corner portions of the cam grooves 68 as shown in FIGS. 1 and 2A. Balls 86 are disposed between the coil spring 85 and the coupling ring 70 to make the coupling ring 70 rotatable. The rear end of the coil spring 85 is held by a rear washer 87 that receives the balls 86.

In the oil unit 60, the shaft 62 rotates together with the main body 61 until a predetermined torque is reached. On the other hand, when an exceeded load of the predetermined torque is applied to the shaft 62, it causes a difference in rotational speed between the shaft 62 and the main body 61. Therefore, a large torque is transmitted to the shaft 62 because of the hydraulic pressure of hydraulic oil accumulated inside the main body 61 as is well known. The shaft 62 is rotatably journaled on an inner surface of the unit case 20 through a ball bearing 21 to project from the front end of the unit case 20 to forward the unit case 20. A chuck 62A is provided at the distal end of the shaft 62, and where a bit can be mounted.

Subsequently, an operation of the oil pulse driver 1 according to the embodiment will be described. At the retracted position P, as shown in FIG. 1, the balls 80, 80 are positioned at corner portions of each of the cam grooves 68 and the corner portions of each of the recessed grooves 71 as shown in FIGS. 1 and 2A. In this state, the coupling ring 70 is integrated with the sleeve body 63 via the balls 80, 80. At the retracted position P, in addition, the cam teeth 70A of the coupling ring 70 mesh with the cam teeth 41A of the carrier 41, which integrally couples the coupling ring 70 to the carrier 41.

For example, when a user pulls the trigger 13 as shown in FIG. 3 to drive the motor 30, rotation of the motor 30 is transmitted to the planetary gears 43, 43 journaled on the carrier 41 via the pinion 42. Subsequently, rotation decelerated by the planetary gears 43, 43 rotates the carrier 41 and the coupling ring 70 together with each other (here, make right-hand rotation when facing toward the front in the center axis direction X). Rotation of the coupling ring 70 is transmitted from the recessed grooves 71, 71 to the cam grooves 68, 68 of the sleeve body 63 and the main body 61 via the balls 80, 80. Therefore, right-hand rotation of the sleeve body 63, the main body 61 and the like rotates the bit mounted to the shaft 62, which enables a screw or the like to be tightened. In the case where a radial load is applied to the center shaft portion 44 due to rotation of the carrier 41, the radial load is absorbed by the needle bearing 65 and the ball bearing 66. In addition, in the case where a thrust load (vibration) is intermittently applied to the center shaft portion 44 due to rotation of the carrier 41, the thrust load is absorbed by the ball bearing 66.

When the load on the shaft 62 is increased in accordance with screwing operation, rotation of the shaft 62 is delayed more than that of the sleeve body 63 and the main body 61. As a result, the oil unit 60 produces an impact torque generated by a hydraulic pressure. The impact torque is intermittently applied to the shaft 62 to enable further screwing.

Figure 2B:
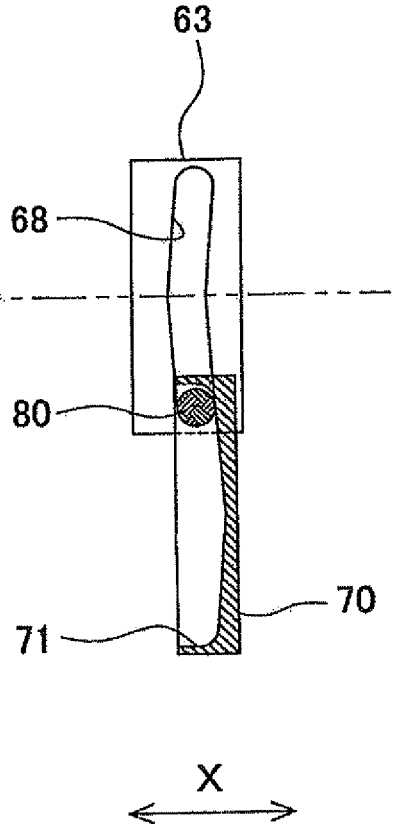
FIG. 2B illustrates a state in which the ball rolls along the cam groove while being engaged with a recessed groove on the coupling ring.

The delay in rotation of the shaft 62 discussed above decreases the rotational speed of the sleeve body 63. Therefore, it causes a difference in rotational speed between the sleeve body 63 and the coupling ring 70 which is to rotate at the same speed as the sleeve body 63. At that time, as shown in FIGS. 2B and 3, the balls 80, 80 roll forward in the center axis direction X along the inclined portions of each of the cam grooves 68 while being engaged with each of the recessed grooves 71. Hence, it causes the coupling ring 70 to contract the coil spring 85 against the urging force of the coil spring 85 and to be pressed forward in the center axis direction X as shown in FIG. 3 while rotating with respect to the sleeve body 63. Further, in this case, as shown in FIG. 3, the coupling ring 70 and the carrier 41 are coupled to each other to rotate together with the cam teeth 70A meshed with the cam teeth 41A. Thus, an impact between the sleeve body 63 and the coupling ring 70 can be relieved.

Thereafter, when the oil unit 60 produces an impact torque to eliminate the delay in rotation of the shaft 62, the coupling ring 70 is urged by a compressive force accumulated in the coil spring 85 to return to the retracted position P. At that time, the balls 80, 80 roll rearward in the center axis direction X along the inclined portions of the cam grooves 68 while being engaged with each of the recessed grooves 71. The impact torque is buffered in accordance with the compressive force accumulated in the coil spring 85. Therefore, it prevents reaction to the planetary gear speed reduction mechanism 40, the motor 30, and the housing 10. Hence, it is possible to prevent damage to the planetary gear speed reduction mechanism 40 and the motor 30, and to suppress transmission of vibration to a hand of the user through the housing 10 (handle portion 12) during the screwing operation.

As discussed above, when the coupling ring 70 returns to the retracted position P, the balls 80, 80 roll along the inclined portions of each of the cam grooves 68. Thus, a torque in the rotational direction is applied to the sleeve body 63, and added to the main body 61. Therefore, an increase in the output torque of the oil unit 60 leads to improvements in energy efficiency and reduction of power consumption.

<Effects of Embodiment>

The oil pulse driver 1 according to the embodiment is provided with the coil spring 85, which is externally mounted on the main body 61 of the oil unit 60 to urge the coupling ring 70 toward the retracted position P. Therefore, the length of the body portion 11 of the housing 10 in the front-rear direction (in the left-right direction in FIGS. 1 and 3) can be reduced unlike in the case where the coil spring 85 aligned with the oil unit 60 is provided in the rear of the oil unit 60, which is on the side of the final stage of the planetary gear speed reduction mechanism 40. Accordingly, it is possible to suppress an increase in the overall length of the oil pulse driver 1 including the body portion 11.

Moreover, as discussed above, the needle bearing 65 is disposed between the hollow portion 64 of the sleeve body 63 and the front portion of the center shaft portion 44 of the carrier 40 in the center axis direction X of the sleeve body 63, and the ball bearing 66 is disposed between the hollow portion 64 of the rear portion of the center shaft portion 44 in the center axis direction X. Therefore, the needle bearing 65 and the ball bearing 66 absorb a radial load, which prevent the center shaft portion 44 from excessively interfering with the sleeve body 63. In addition, the ball bearing 66 can also absorb a thrust load.

The present invention is not limited to the embodiment discussed above, and part of the configuration of the embodiment may be modified appropriately with not departing from the scope of the present invention. For example, unlike in the embodiment discussed above, two ball bearings may be disposed in the center axis direction X by replacing the needle bearing 65 with a ball bearing so that a thrust load and a radial load are absorbed by the two ball bearings.

In the embodiment discussed above, the present invention is applied to the oil pulse driver 1. However, the present invention may be applied to an oil pulse wrench or the like.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims.

What is claimed is:

1. An oil pulse rotary tool comprising:

a housing;

a motor accommodated in the housing;

a speed reduction mechanism which is accommodated in the housing and to which a torque is transmitted from the motor;

an oil pulse generator accommodated in the housing and disposed in front of and coaxially with an output portion serving as a final stage of the speed reduction mechanism;

a sleeve body integrally coupled to the oil pulse generator and externally mounted on and coaxially with a center shaft portion provided to project from a center of rotation of the output portion with a bearing interposed between the sleeve body and the center shaft portion;

a coupling body externally mounted on and coaxially with the sleeve body so as to be rotatable together with the output portion and axially movable;

a ball fitted between an outer surface of the sleeve body and an inner surface of the coupling body across the outer surface of the sleeve body and the inner surface of the coupling body;

a cam groove that is formed from a center axis side of the sleeve body toward an outer surface side of the sleeve body, where the cam groove is inclined from the center axis side of the sleeve body toward a portion of the outer surface of the sleeve body at which the ball is fitted; and a coil spring externally mounted on the oil pulse generator to urge the coupling body toward a retracted position at which the ball is fitted at a rear end of the cam groove, wherein rotation of the output portion is transmitted from the coupling body to the sleeve body and the oil pulse generator via the ball, wherein when rotational speed between the sleeve body and the coupling body is different, the ball relatively turns in the cam groove to move the coupling body forward against an urging force of the coil spring so as to relieve an impact.

2. The oil pulse rotary tool according to claim 1, wherein two bearings are disposed in the axial direction between the center shaft portion and the sleeve body.

3. The oil pulse rotary tool according to claim 2, wherein one of the two bearings is a needle bearing, and the other of the bearings is a ball bearing.

4. The oil pulse rotary tool according to claim 2, wherein each of the two bearings is a ball bearing.

5. The oil pulse rotary tool according to claim 1, further comprising:

a first cam tooth provided to project from the output portion; and a second cam tooth that is provided to project from the coupling body and that can mesh with the first cam tooth, wherein the first cam tooth is meshed with the second cam tooth each other, and the coupling body can rotate together with the output portion.

6. The oil pulse rotary tool according to claim 1, wherein a recessed groove is formed in an inner surface of the coupling body, and the ball is fitted across the recessed groove.

7. The oil pulse rotary tool according to claim 1, wherein the coil spring is externally mounted on the oil pulse generator in a state where the coil spring is fitted between a first washer member externally mounted on the oil pulse generator and the coupling body.

8. The oil pulse rotary tool according to claim 7, wherein a portion of the coil spring on the coupling body side is held by a second washer member that receives a ball member contacting the coupling body so as to be rollable.

* * * * *